US006070741A

United States Patent [19]

Bachman et al.

[11] Patent Number: 6,070,741

[45] Date of Patent: Jun. 6, 2000

[54] MEMORIAL DEATH CARE MERCHANDISE DISPLAY UNIT AND METHOD FOR DISPLAYING DEATH CARE MERCHANDISE

[75] Inventors: Douglas E. Bachman, Columbus, Ohio; Lynn A. Taggart, Marblehead, Me.; Alton F. Doody, New Orleans, La.

[73] Assignee: The York Group, Inc., Houston, Tex.

[21] Appl. No.: 09/205,080

[22] Filed: Dec. 4, 1998

[51] Int. Cl.[7] ..... A47F 7/00

[52] U.S. Cl. ..... 211/13.1; 211/189; 211/85.16; 211/85.27; 211/90.01; 211/159; 52/36.1

[58] Field of Search ..... 211/85.16, 13.1, 211/85.27, 90.01, 90.04, 45, 187, 189, 90.02; 52/36.1

[56] References Cited

U.S. PATENT DOCUMENTS

| | | | |
|---|---|---|---|
| D. 350,246 | 9/1994 | Louise et al. | D6/479 |
| D. 351,076 | 10/1994 | Eliadis et al. | D6/476 |
| D. 397,562 | 9/1998 | DePottey et al. | D6/468 |
| 2,580,334 | 12/1951 | Vandeveld | 211/189 X |
| 3,190,243 | 6/1965 | Pira | 108/152 |
| 3,585,944 | 6/1971 | Scheer | 108/111 |
| 4,119,207 | 10/1978 | Fuller et al. | 211/189 X |
| 4,197,950 | 4/1980 | Ovitz | 211/45 X |
| 4,891,897 | 1/1990 | Gieske et al. | 40/618 |
| 4,925,038 | 5/1990 | Gajewski | 211/59.2 |
| 5,370,249 | 12/1994 | Harvey et al. | 211/189 |
| 5,405,017 | 4/1995 | Szabo et al. | 211/13.1 |
| 5,495,954 | 3/1996 | Schmit | 211/90 |
| 5,622,010 | 4/1997 | Weber | 52/36.4 |
| 5,702,011 | 12/1997 | Carroll | 211/189 X |
| 5,711,115 | 1/1998 | Wirt | 52/36.3 |
| 5,759,045 | 6/1998 | Gabig et al. | 434/367 |
| 5,775,034 | 7/1998 | Logue | 52/36.1 |
| 5,797,499 | 8/1998 | Pinco | 211/13.1 |
| 5,901,862 | 5/1999 | Riga et al. | 211/85.16 |

OTHER PUBLICATIONS

Quarter Coffin Designs Practiced in France (photos attached).

*Primary Examiner*—Robert W. Gibson, Jr.
*Attorney, Agent, or Firm*—Stevens, Davis, Miller & Mosher, L.L.P.

[57] ABSTRACT

A memorial death care merchandise display unit and method of displaying the unit that maximizes the types and styles of death care merchandise comprising two vertical, parallel, spaced wing walls and a vertical back wall attached to a rear end of each wing wall. Attached to the back wall and/or the wing walls is at least one angled display board to engage the line of sight of a prospective purchaser and provide a location for the multi-planar display of a variety of death care merchandise, decedent confinement chambers, and visual materials. Additionally, the unit may further contain a cornice and/or at least one illumination source to improve the visibility and notoriety of the death care merchandise. Alternatively, at least two display units are combined to create a modular memorial death care merchandise display unit capable of depicting a plurality of death care merchandise, decedent confinement chambers, and visual materials design lines. This configuration allows the consumer an opportunity to compare a plurality of death care merchandise design lines in one setting.

22 Claims, 5 Drawing Sheets

MEMORIAL DEATH CARE MERCHANDISE DISPLAY UNIT AND METHOD FOR DISPLAYING DEATH CARE MERCHANDISE

FIELD OF THE INVENTION

The present invention relates to an integrated display unit and a method of displaying the unit for death care merchandise, decedent confinement chambers, and visual materials. The display systems of the invention are particularly designed for use by prospective purchasers in a preview room.

BACKGROUND OF THE INVENTION

Various casket display systems are known in the art. The more primitive of such systems consist of a casket display rack or support. See, for instance, U.S. Pat. No. 2,937,768 which discloses a two-tiered casket display rack having a rigid C-shaped frame like structure for the display of two caskets-one casket supported above another.

While the casket display system of the '017 patent offers a more serene setting than the primitive systems of the prior art, as set forth in the '768 patent, they do not permit the full display of merchandise used in the funeral and death care industry. In addition, it does not permit the display of all types of merchandise such as adornment accessories, urns, and burial vaults.

Modem techniques of displaying death care merchandise include U.S. Pat. No. 5,759,045, which discloses a product display board capable of displaying multiple product display lines. By arranging three product lines in rows along the board, '045 offers a comparison of the options available to those in the market for death care merchandise. However, this display fails to provide for the display of death merchandise in more than one plane, a more attention grabbing and appealing method of display. Additionally, this display system fails to angle the death care merchandise to the line of sight of the prospective purchaser, thus better engaging the prospective purchaser. Finally, '045 modes not offer illumination to aid in a purchaser's consideration.

The need exists therefore for a display system which permits the exhibition of a greater volume and a greater type of death care merchandise with greater ease on the prospective purchaser. In addition, the need exists for a display system which can be more easily assembled and utilized than afforded by the systems of the prior art that will more easily engage the attention of prospective purchasers of death care merchandise and provide a method of display that allows the prospective purchaser to consider various design lines of death care merchandise, decedent confinement chambers, and visual materials.

SUMMARY OF THE INVENTION

A memorial death care merchandise display unit and a method of displaying the unit that maximizes the types and styles of death care merchandise comprising two vertical, parallel, spaced wing walls and a vertical back wall attached to a rear end of each wing wall. Attached to the back wall and/or the wing walls is at least one panel bracket that supports at least one angled display board to engage the line of sight of a prospective purchaser and provide a location for the multi-planar display of a variety of death care merchandise, decedent confinement chambers, and visual materials.

The display unit may further contain a cornice. The cornice can present information for the purposes of indication and identification of the death care related merchandise being displayed. Alternatively, the cornice provides a location for attaching visual materials. In a preferred embodiment, the cornice is attached to a front edge of each wing wall. Alternatively or additionally, the cornice can attach to the back wall. The display unit may also comprise at least one illumination source to improve the visibility and notoriety of the death care merchandise, decedent confinement chambers, and visual materials being displayed. In a preferred embodiment of the invention, a plurality of illumination sources are attached to all inside or bottom surface of the cornice and behind each angled display board.

Furthermore, the back wall may contain a plurality of parallel, spaced slats. These slats are evenly spaced to allow the insertion of at least one fastener, preferably a J-hook fastener, into the plurality of slots created by the uniform arrangement of the slats attached to the back wall. This configuration allows each angled display board assembly and possibly a shelf equipped with an appropriate fastener to be inserted into at least one slot in the slat wall. This configuration offers the flexibility and convenience of allowing a multitude of configurations for the display of death care merchandise, decedent confinement chambers, and visual materials.

In a most preferred embodiment, at least two display units are combined to create a memorial death care merchandise display unit capable of depicting a plurality of death care merchandise, decedent confinement chambers, and visual materials design lines. This configuration allows the consumer an opportunity to compare a plurality of death care merchandise design lines in one setting.

DETAILED DESCRIPTION OF PREFERRED EMBODIMENT

The present invention provides an integrated display system for death care related merchandise. The display system of the invention is principally used in a preview room where the selection of death care related merchandise by the decedent's loved ones occurs. In addition, the display system of the present invention may be used in death related ceremonial areas such as the viewing room of a funeral home as well as at funeral and memorial services. One of the principal advantages of the display system of the present invention is that it maximizes the number and types of death care merchandise which may be displayed in a given area.

The display system of the invention may further be a modular assembly; permitting it to be assembled and disassembled within a short period of time as well as on an "as needed" basis. The ability of the display system to be modular permits purchasers to buy all or sections of the system when so desired. Additionally, the modular assembly allows the display of a plurality of designs of death care merchandise, decedent confinement chambers, and visual materials, thus allowing the prospective purchase to consider the comparable design lines.

Figure 1:
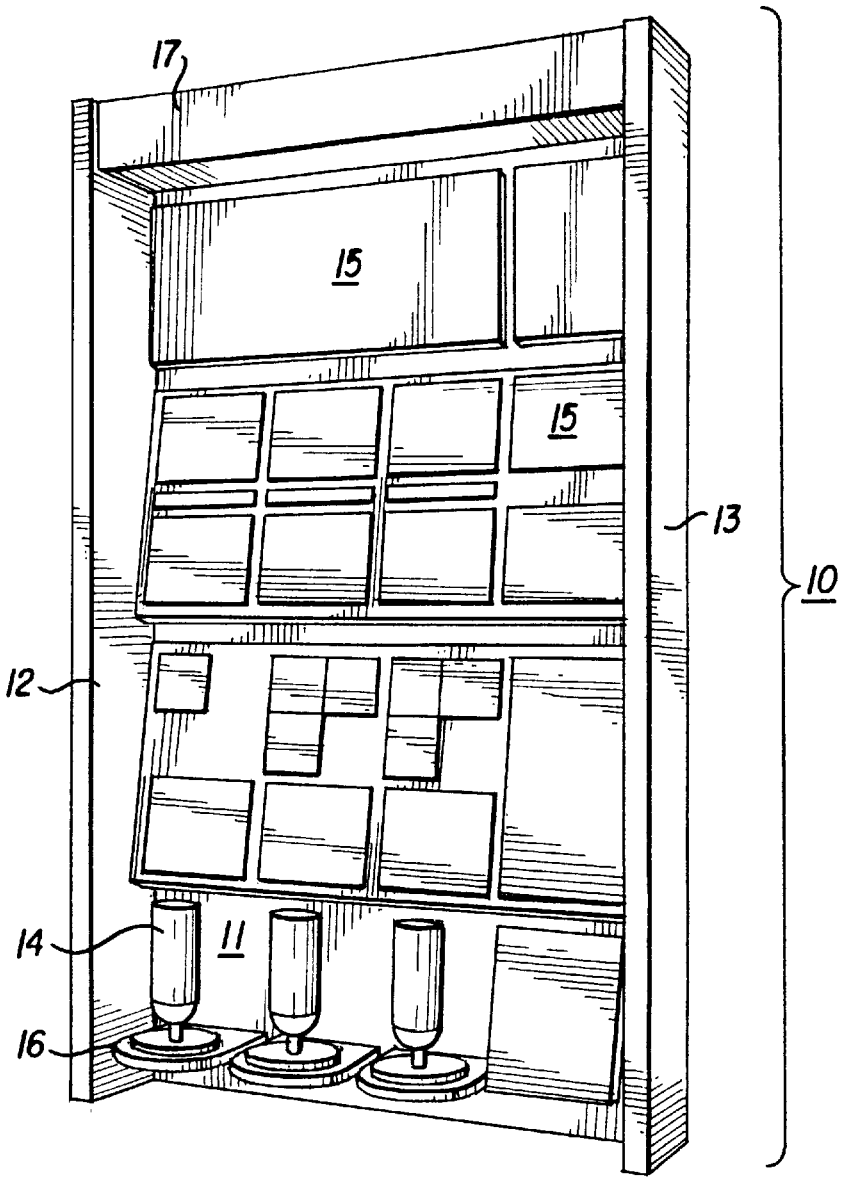
FIG. 1 is a perspective of the display unit.
Figure 3:
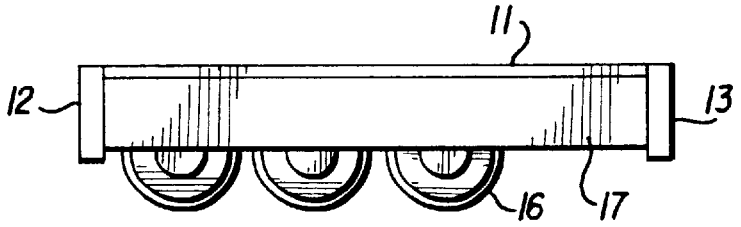
FIG. 3 is a plan view of the display unit.
Figure 2:
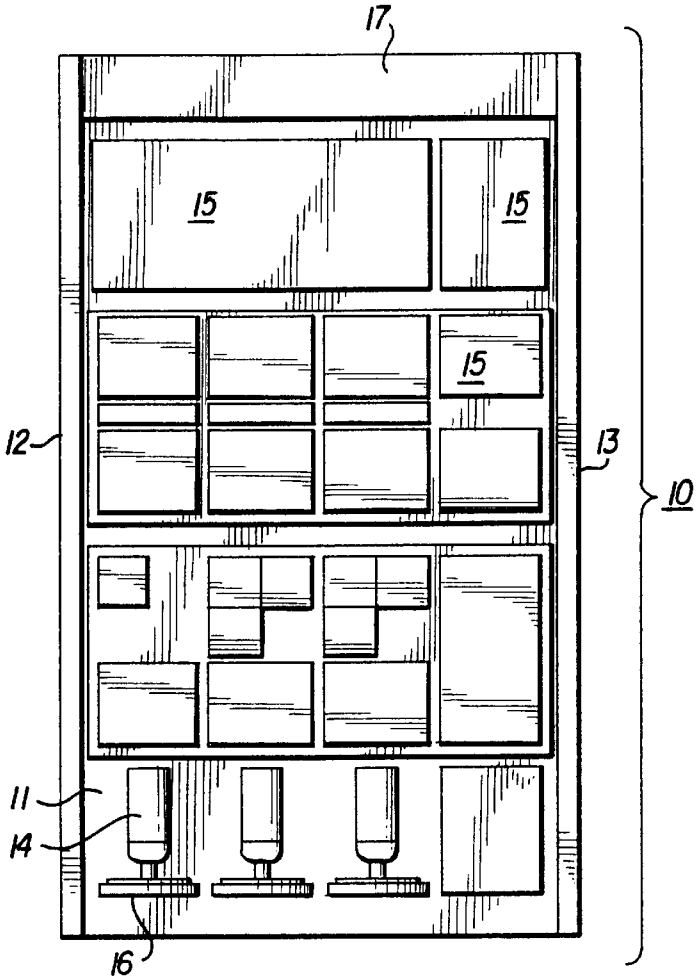
FIG. 2 is an elevation view of the display unit.

The present invention contains a number of novel features that may be used alone or in combination with each other. FIGS. 1, 2, and 3 show a perspective view, an elevation view, and a plan view, respectively, of a memorial death care merchandise display unit 10. The display unit 10 comprises a back wall 11 and two wing walls 12 and 13 that are arranged such that they have facing surfaces and opposing surfaces. The wing walls 12 and 13 are attached to the back wall 11 at the rear end of each wing wall 12 and 13. Alternatively, the back wall 11 may be removably secured to the rear end of the wing walls 12 and 13.

The back wall 11 and the wing walls 12 and 13 of the display unit 10 are typically plywood but may be fiberwood or other durable material such as a synthetic plastic material as plexiglass or Mylar. The back wall 11 and/or the wing walls 12 and 13 may be covered with a fabric-like material or have a textured surface. When so desired, the fabric-like material may be removably attached as described below to the back wall 11 or wing walls 12 and 13, allowing the user to select the color and texture.

As used herein, the term "decedent confinement chamber" shall refer to caskets, coffins, burial vaults, and urns. The term shall include ready for use caskets, coffins, burial vaults, and urns, the facade of caskets, coffins, burial vaults, and urns, sectionals of caskets, coffins, burial vaults, and urns, and miniatures thereof. Where the displays are to be used in a preview room and designed not to be opened, it is specially preferred to use facades of such caskets, coffins, burial vaults, and urns. The facade typically includes those outer sides and surfaces of the chamber visible to the observer. Where the chamber is being used to exhibit only the facade, the inner chamber is hollow.

The back wall 11 and the wing walls 12 and 13 provide a location for one or more death care related visual materials 15 such as cards, flowers, books, personal memorabilia, ornamental trims, fixtures, drawings, placards, marks, tokens, crests, plaques, emblems, insignias, logos, descriptions, signatures, signs, fabrics for the cap panel—that portion of the interior of the chamber lining the upper part of the lid—and the overlay—the fabric which lies across the outside of the decedent confinement chamber when the lid of the chamber is open, samples, texts, photographs, and materials for decorating or adorning the same. These visual materials 15 are used to inform prospective purchasers of features of the displayed death care merchandise. The visual materials 15 are preferably attached by attachments that include peg-board type attachments, slat wall attachments described below, tackable surfaces, hook-and-loop fabric (e.g., VELCRO®) attachments, magnetic attachments, or other known devices for removably attaching objects to a surface for display of the objects. Alternatively, the visual materials 15 can be more permanently attached by adhesives or mechanical means including brackets, screws, bolts, nails, rivets, or other known devices for attaching objects to a surface for display. Any of the visual materials 15 may comprise information about either the decedent (where the unit is employed in memorial settings or funerals) or the merchandise displayed (where the unit is employed for point-of-sale merchandise). For instance, in point-of-sale merchandise, the information center can display information about the materials used in the manufacture of the decedent confinement chamber, such as Stainless Steel, Veneer, Hardwood, Steel, Bronze, etc. as well as information about the merchandise on display, such as Interiors for a display illustrating the interior of the decedent confinement chamber. In the preferred embodiment, some of these visual materials 15 provide information about the design line of the death care merchandise being displayed.

Additionally, the alcove defined by the back wall 11, the left wing wall 12, and the right wing wall 13 can display one or more decedent confinement chambers 14. When used in a preview room display setting, each of the decedent confinement chambers 14 may be displayed with any death care merchandise, any visual materials 15, or other communicative materials that provide information to the prospective purchaser of the death care merchandise or decedent confinement chambers 14.

The back wall 11 and the wing walls 12 and 13, as illustrated in FIGS. 1, 2, and 3 are typically 5 to 7 feet, preferably 6 feet, tall. Though a plurality of urns are shown in FIGS. 1, 2, and 3, the width of the back wall 11 can be wide enough to display an actual size decedent confinement chamber 14. In the preferred embodiment of the invention, however, the back wall 11 of the display unit 10 is approximately four feet wide.

The decedent confinement chambers 14 may be easily mounted onto the back wall 11 or the wing walls 12 and 13 of the display unit 10. In the preferred embodiment, at least one shelf 16 can be attached to the back wall 11 or the wing walls 12 and 13. Though any of the methods of removable or permanent attachment described above are applicable to the attachment of the shelf, the preferred embodiment of the invention uses a fastener inserted into at least one slot formed in a slat wall configuration. The slat wall configuration comprises a plurality of uniform, parallel slats attached to the back wall and/or the wing walls to form a plurality of uniform slots for the insertion of fasteners. The shelves 16 further comprise at least one fastener, preferably a J-hook fastener, that can be inserted within the recessed slots defined by the slat wall. Alternatively, elbow shelving joining adjacent slots may further be used in place of shelving 16. The elbow shelving comprises a horizontally flat section, and a support, angled to fit into the adjacent slot. Moreover, death care merchandise, decedent confinement chambers 14, and/or visual materials 15 may also be displayed on the flat section formed.

This shelf 16 provides a support for any form of death care merchandise, but preferably provides support for at least one decedent confinement chamber 14. In FIGS. 1, 2, and 3, a plurality of decedent confinement chambers 14 are shown, being supported by a corresponding plurality of shelves 16 that are attached to the back wall 11 of the display unit 10.

The display unit 10 may further comprise a cornice 17. Any conventional cornice or soffit disclosed in the art may suffice. For instance, the preferred cornice 17 comprises a horizontal beam which attaches to a front end of both wing walls 12 and 13. Alternatively, the cornice 17 can comprise a left cantilevered vertical beam and a right cantilevered vertical beam extending from the back wall 10. A horizontal beam is attached to the frontmost lateral edges of the vertical beams. Typically, the cornice 17 will increase the height of the display unit 10 to above 7 feet.

Figure 4:
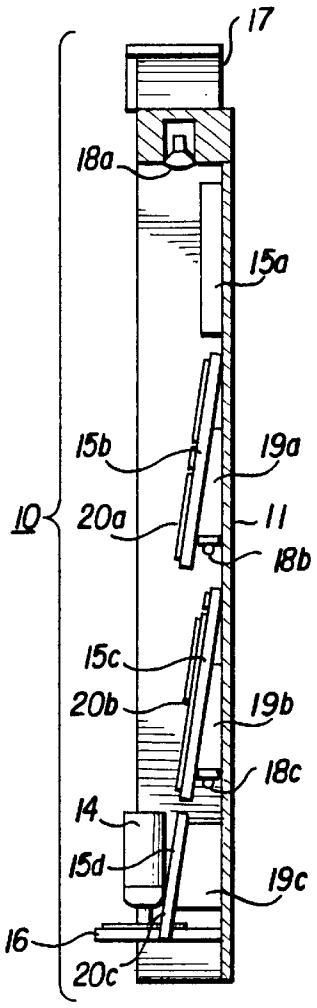
FIG. 4 is a sectional side view of the display unit.

As shown in FIG. 4, the display unit 10 may also comprise a plurality of panel brackets 19*a*, 19*b*, and/or 19*c* that are either removably or permanently attached to the back wall 11 and/or the wing walls 12 and 13. At least one angled display board 20*a*, 20*b*, and/or 20*c* can be attached directly to the back wall 11 and/or the wing walls 12 and 13 or preferably to at least one panel bracket 19*a*, 19*b*, and/or 19*c* to provide a visually appealing location for the attachment of death care merchandise, decedent confinement chambers 14, and/or visual materials 15*a*, 15*b*, 15*c*, and/or 15*d* such that the angled display board has a slope that is not parallel to the plane of the back wall 11. Though any of the permanent or removable methods of attachment previously described are appropriate, the preferred embodiment comprises fasteners, most preferably J-hook fasteners, on a rear portion of the panel brackets 19*a*, 19*b*, and/or 19*c* that are inserted into at least one slot of a slat wall configuration on the back wall 11 or the wing walls 12 and 13. By presenting the death care merchandise, the decedent confinement chambers 14, and/or the visual materials 15*a*, 16*b*, 15*c*, and/or 15*d* in a plurality of planes to the prospective purchaser, they can be also be effectively illuminated.

The display unit 10 may further comprise at least one illumination source 18*a*, 18*b*, 18*c*, and/or 18*d*. The illumination source 18*a*, 18*b*, 18*c*, and/or 18*d* may be concealed to the observer within the interior or bottom surface of the cornice 17, if included, or behind any angled display board 20*a*, 20*b*, and/or 20*c*. Exemplary of the illumination sources 18*a*, 18*b*, 18*c*, and/or 18*d* available are integrated lights, candescent lights, fluorescent lights, track lights, or pendant lights. Practically any light source that may easily be manipulated such that the light is directed onto selected death care merchandise, decedent confinement chambers 14, or visual materials 15*a*, 15*b*, 15*c*, and/or 15*d* will suffice. The illumination source 18*a*, 18*b*, 18*c*, and/or 18*d* is attached by one of the attachment means previously described to a bottom or inside surface of the cornice 17, if included, and behind any angled display board 20*a*, 20*b*, and/or 20*c*.

As set forth in FIG. 4, a plurality of illumination sources 18*a*, 18*b*, and 18*c* are attached to the bottom surface of the cornice 17 and behind the angled display boards 20*a* and 20*b*, respectively, to provide light on any display of death care merchandise, decedent confinement chambers 14, or visual materials 15*a*, 15*b*, 15*c*, and 15*d* within the display unit 10. In this preferred embodiment, by providing a plurality of angled display boards 20*a*, 20*b*, and 20*c* attached to a plurality of panel brackets 19*a*, 19*b*, and 19*c*, respectively, the visual materials 15*b*, 15*c*, and 15*d* are equally noticed as the visual materials 15a presented at the approximate eye level of the prospective purchaser. By illuminating all visual materials 15*a*, 15*b*, 15*c*, and 15*d* equally, the prospective purchaser is presented with an engaging display unit 10 while considering his or her purchase options.

A plurality of chambers are formed behind any any angled display board 20*a*, 20*b*, and/or 20*c* and the back wall 11. Additionally, another chamber is formed by the cornice 17, when included, and the back wall 11. These chambers provide a location to store any necessary electrical cable wiring. The wiring can be routed through at least one aperture formed, drilled, cut, or punctured in the back wall 11. The electrical wiring is not evident to the prospective purchaser.

Figure 5:
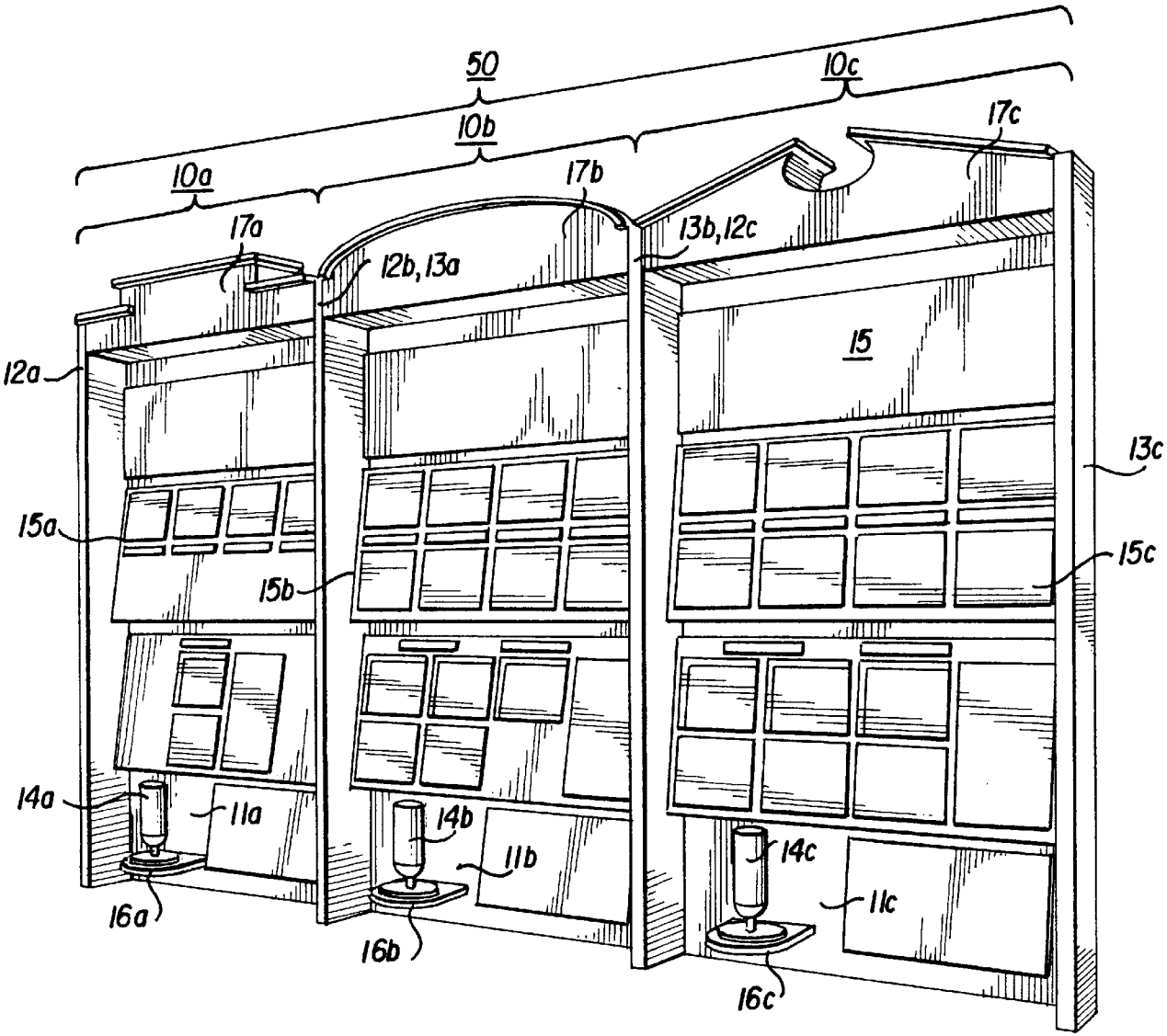
FIG. 5 is a perspective view of a preferred embodiment of the display unit in a modular configuration.
Figure 6:
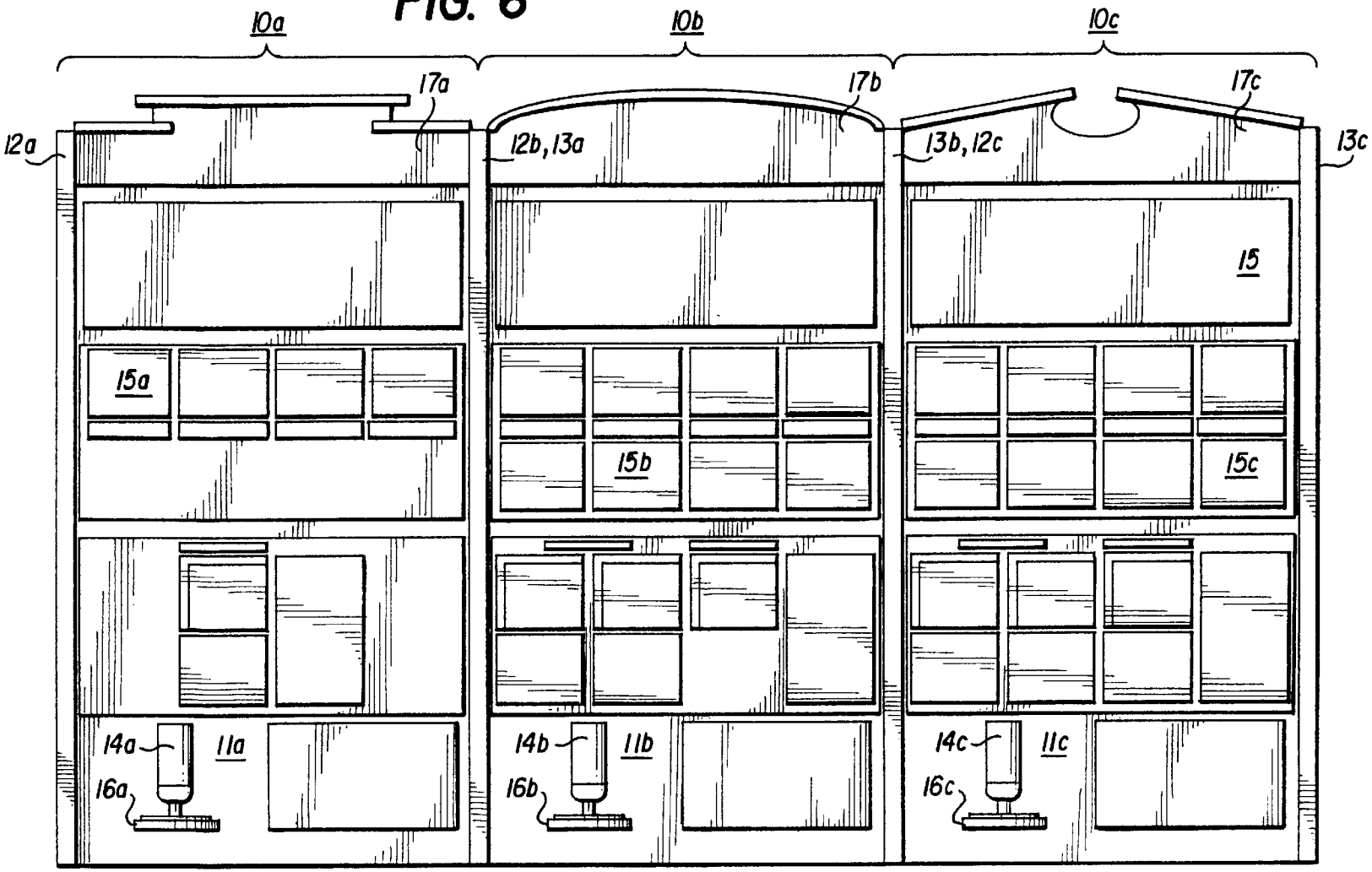
FIG. 6 is an elevation view of a preferred embodiment of the display unit in a modular configuration.
Figure 7:
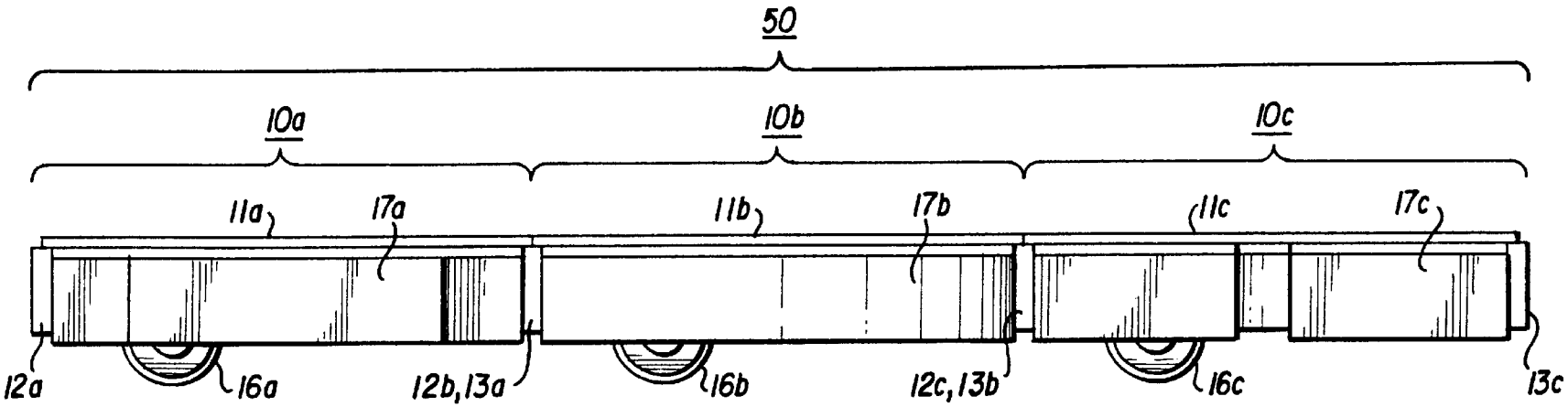
FIG. 7 is a plan view of a preferred embodiment of the display unit in a modular configuration.

Additionally, as shown in a preferred embodiment in FIGS. 5, 6, and 7, a display unit 10*a* can be either permanently or removably attached to at least one other display unit 10*b* to provide a modular display unit 50. In this configuration, a plurality of display units 10*a*, 10*b*, and 10*c*, for example, are attached to one another at the wing walls 13*a* to 12*b* and 13*b* to 12*c*. Alternatively, the display units 10*a* and 10*b* can share a common wing wall 13*a*/12*b* and the display units 10*b* and 10*c* can share a common wing wall 13*b*/12*c*. Though this configuration reduces the flexibility of the modular display unit 50, less materials are required.

The modular display unit 50 allows more than one design line of death care merchandise, decedent confinement chambers 14, and/or visual materials 15 to be displayed for the prospective purchaser's consideration. By altering the shape of the cornices 17*a*, 17*b*, and 17*c*, the modular display unit 50 can further distinguish the plurality of design lines being offered. As shown in FIGS. 5, 6, and 7, the visual materials 15*a*, 15*b*, and 15*c* can be displayed so that a prospective purchaser can effectively consider the quality and merits of several different design lines of death care merchandise, decedent confinement chambers 14, and/or visual materials 15 to make a more efficient and more informed decision. The modular display unit 50 allows the mixing or matching of various display units 10 as well as allowing the subsequent purchase of additional display units 10 to offer additional design lines or more of the design lines presently being offered in the modular display unit 50.

Various modifications may be made in the nature, composition, operation and arrangement of the various elements, steps and procedures described herein without departing from the spirit and scope of the invention as defined in the following claims.

We claim:

1. A memorial death care merchandise display unit comprising:

a vertical back wall having a front surface;

two vertical, parallel, spaced wing walls, having facing and opposite surfaces, attached to the back wall at a rear end of each wing wall such that the back wall supports and maintains the wing walls in a vertical attitude; and at least one display board attached to the back wall, said display board being angled with regard to the back wall and having a slope that is neither parallel nor perpendicular to the plane of the vertical back wall.

2. The memorial death care merchandise display unit of claim 1, further comprising at least one item selected from the group consisting of death care merchandise, decedent confinement chambers, and visual material attached to the display surface of each display board.

3. The memorial death care merchandise display unit of claim 1, further comprising a cornice attached to a front end of each wing wall.

4. The memorial death care merchandise display unit of claim 1, further comprising a cornice having a mounting member cantilevered from the back wall, the mounting member comprising two vertical panels and a horizontal beam secured to the vertical panels.

5. The memorial death care merchandise display unit of claim 1, further comprising at least one illumination source attached behind at least one of said display board and at least one aperture in the back wall to provide a passageway for any electrical wiring from each illumination source to exit the memorial death care merchandise display unit.

6. The memorial death care merchandise display unit of claim 3, further comprising at least one illumination source attached to an inside or bottom surface of the cornice and an aperture in the back wall to provide a passageway for any electrical wiring from each illumination source to exit the memorial death care merchandise display unit.

7. The memorial death care merchandise display unit of claim 1, further comprising at least one shelf attached to the back wall and at least one decedent confinement chamber supported by the shelf.

8. The memorial death care merchandise display unit of claim 1, wherein the back wall is comprised of a plurality of uniform, parallel slats to form a plurality of uniform, parallel slots; and wherein each display board is fastened to at least one slot.

9. The memorial death care merchandise display unit of claim 8, further comprising at least one item selected from the group consisting of death care merchandise, decedent confinement chambers, and visual material attached to the display surface at least one of said display board.

10. The memorial death care merchandise display unit of claim 8, further comprising a shelf fastened to at least one slot and at least one decedent confinement chamber supported by the shelf.

11. A memorial death care merchandise display unit comprising:

a first modular memorial death care merchandise unit comprising:

a vertical back wall having a front surface;

two vertical, parallel, spaced wing walls, having facing and opposite surfaces, attached to the back wall at a rear end of each wing wall such that the back wall supports and maintains the wing walls in a vertical attitude; and at least one display board attached to the back wall, said display board having a slope that is neither parallel nor perpendicular to the plane of the vertical back wall;

a second modular memorial death care merchandise unit comprising:

a vertical back wall having a front surface;

two vertical, parallel, spaced wing walls, having facing and opposite surfaces, attached to the back wall at a rear end of each wing wall such that the back wall supports and maintains the wing walls in a vertical attitude; and at least one display board attached to the back wall, said display board having a slope that is neither parallel nor perpendicular to the plane of the vertical back wall;

wherein the first modular memorial death care merchandise unit interfaces with the second modular memorial death care merchandise unit.

12. The memorial death care merchandise display unit of claim 11, further comprising at least one item selected from the group consisting of death care merchandise, decedent confinement chambers, and visual materials attached to the display surface of at least one of said display board.

13. The memorial death care merchandise display unit of claim 11, wherein the opposite surface of a right wing wall of the first modular memorial death care merchandise unit is attached to the opposite surface of a left wing wall of the second modular memorial death care merchandise unit.

14. The memorial death care merchandise display unit of claim 11, wherein a right wing wall of the first modular memorial death care merchandise unit is shared as the left wing wall of the second modular memorial death care merchandise unit.

15. The memorial death care merchandise display unit of claim 11, further comprising a first cornice attached to a front end of the wing walls of the first modular memorial death care merchandise unit and a second cornice is attached to a front end of the wing walls of the second modular memorial death care merchandise unit.

16. The memorial death care merchandise display unit of claim 11, further comprising:

a first cornice having a mounting member cantilevered from the back wall of the first modular memorial death care merchandise display unit, the mounting member comprising two vertical panels and a horizontal beam secured to the vertical panels, and a second cornice having a mounting member cantilevered from the back wall of the second modular memorial death care merchandise display unit, the mounting member comprising two vertical panels and a horizontal beam secured to the vertical panels.

17. The memorial death care merchandise display unit of claim 11, further comprising:

at least one illumination source attached behind said at least one display board of the first modular memorial death care merchandise display unit and at least one aperture in the back wall of the first modular memorial death care merchandise display unit to provide a passageway for any electrical wiring from the illumination source to exit the first modular memorial death care merchandise display unit; and at least one illumination source attached behind said at least one display board of the second modular memorial death care merchandise display unit and at least one aperture in the back wall of the second modular memorial death care merchandise display unit to provide a passageway for any electrical wiring from the illumination source to exit the second modular memorial death care merchandise display unit.

18. The memorial death care merchandise display unit of claim 15, further comprising:

at least one illumination source attached to an inside or bottom surface of the cornice of the first modular memorial death care merchandise display unit and an aperture in the back wall of the first modular memorial death care merchandise display unit to provide a passageway for any electrical wiring from the illumination source to exit the first modular memorial death care merchandise display unit; and at least one illumination source attached to an inside or bottom surface of the cornice of the second modular memorial death care merchandise display unit and an aperture in the back wall of the second modular memorial death care merchandise display unit to provide a passageway for any electrical wiring from the illumination source to exit the second modular memorial death care merchandise display unit.

19. The memorial death care merchandise display unit of claim 11, wherein each back wall is comprised of a plurality of uniform, parallel slats of both the first modular memorial death care merchandise display unit and the second modular memorial death care merchandise display unit to form a plurality of uniform, parallel slots;

wherein said at least one display board is fastened into at least one slot.

20. The memorial death care merchandise display unit of claim 19, further comprising at least one item selected from the group consisting of death care merchandise, decedent confinement chambers, and visual materials attached to the display surface of said at least one display board.

21. The memorial death care merchandise display unit of claim 19, further comprising a plurality of shelves fastened into at least one slot and at least one decedent confinement chamber supported by a shelf.

22. A method of displaying death care merchandise which comprises:

assembling a memorial death care merchandise display unit comprising:

a vertical back wall having a front surface;

two vertical, parallel, spaced wing walls, having facing and opposite surfaces, attached to the back wall such that the back wall supports and maintains the wing walls in a vertical attitude; and at least one display board attached to said back wall, said display board having a slope that is neither parallel nor perpendicular to the plane of the back wall; and displaying at least one item selected from the group consisting of death care merchandise, decedent confinement chambers, and visual material by attaching the item to the display surface of said at least one display board.

* * * * *